US007728805B2

(12) United States Patent
Uekuri et al.

(10) Patent No.: US 7,728,805 B2
(45) Date of Patent: Jun. 1, 2010

(54) LIQUID CRYSTAL DISPLAY CAPABLE OF MAKING FLICKER DIFFICULT TO BE OBSERVED AND REDUCING POWER CONSUMPTION

(75) Inventors: Tamotsu Uekuri, Gifu (JP); Yusuke Tsutsui, Gifu (JP); Makoto Kitagawa, Gifu (JP)

(73) Assignee: Sanyo Electric Co., Ltd., Osaka (JP)

( * ) Notice: Subject to any disclaimer, the term of this patent is extended or adjusted under 35 U.S.C. 154(b) by 908 days.

(21) Appl. No.: 11/283,045

(22) Filed: Nov. 21, 2005

(65) Prior Publication Data

US 2006/0208991 A1 Sep. 21, 2006

(30) Foreign Application Priority Data

Nov. 30, 2004 (JP) ..... 2004-346154

(51) Int. Cl.
*G09G 3/36* (2006.01)

(52) U.S. Cl. ..... 345/96; 345/90; 345/94; 345/98

(58) Field of Classification Search ..... 345/87–100
See application file for complete search history.

(56) References Cited

U.S. PATENT DOCUMENTS 4,645,303 A * 2/1987 Sekiya et al. ..... 345/96
5,694,061 A * 12/1997 Morosawa et al. ..... 326/119
6,115,018 A * 9/2000 Okumura et al. ..... 345/95
6,377,235 B1 * 4/2002 Murade et al. ..... 345/100
7,042,433 B1 * 5/2006 Kubota et al. ..... 345/100
7,079,100 B2 * 7/2006 Miyajima et al. ..... 345/90
7,133,035 B2 * 11/2006 Kim et al. ..... 345/96
2002/0084969 A1 * 7/2002 Ozawa ..... 345/96
2005/0195146 A1 * 9/2005 Senda ..... 345/94
2006/0119755 A1 * 6/2006 Senda et al. ..... 349/38

FOREIGN PATENT DOCUMENTS

JP 2003150127 A * 5/2003

OTHER PUBLICATIONS

Yasoji Suzuki, "Introduction to Liquid Crystal Display Engineering," The Daily Industrial News, Nov. 20, 1998, pp. 101-103.

* cited by examiner

*Primary Examiner*—Richard Hjerpe
*Assistant Examiner*—Dorothy Webb
(74) *Attorney, Agent, or Firm*—McDermott Will & Emery LLP

(57) ABSTRACT

A display capable of rendering flickering hard to visually recognize, reducing power consumption and simplifying the structure of a circuit for negatively/positively reversing an image is provided. This display comprises a plurality of drain lines and a plurality of gate lines, a first pixel portion and a second pixel portion each including a subsidiary capacitor having a first electrode and a second electrode and a first subsidiary capacitance line and a second subsidiary capacitance line connected to the subsidiary capacitors of the first pixel portion and the second pixel portion respectively. The display also comprises a signal supply circuit supplying either a first signal or a second signal for negatively/positively reversing an image to the first subsidiary capacitance line of the first pixel portion when displaying the image while supplying either a third signal or a fourth signal for negatively/positively reversing the image to the second subsidiary capacitance line of the second pixel portion when reversing the image.

18 Claims, 8 Drawing Sheets

LIQUID CRYSTAL DISPLAY CAPABLE OF MAKING FLICKER DIFFICULT TO BE OBSERVED AND REDUCING POWER CONSUMPTION

CROSS-REFERENCE TO RELATED APPLICATIONS

The priority application number JP2004-346154 upon which this patent application is based is hereby incorporated by reference.

BACKGROUND OF THE INVENTION

1. Field of the Invention

The present invention relates to a display, and more particularly, it relates to a display having a pixel portion.

2. Description of the Background Art

A liquid crystal display comprising a pixel portion including a liquid crystal layer is generally known as a display. In the conventional liquid crystal display, the liquid crystal layer of the pixel portion is held between a pixel electrode and a common electrode. The conventional liquid crystal display changes the arrangement of liquid crystal molecules by controlling a voltage (video signal) applied to the pixel electrode of the pixel portion, thereby displaying an image responsive to the video signal on a display portion.

When the aforementioned liquid crystal display applies a dc voltage to the liquid crystals (pixel electrode) of the pixel portion over a long period, an afterimage phenomenon referred to as seizure takes place. Therefore, the liquid crystal display must be driven by a method of inverting the voltage supply source (pixel voltage supply source) of the pixel electrode with respect to that of the common electrode in a prescribed cycle. For example, the liquid crystal display is driven by a DC driving method applying a dc voltage to the common electrode. Line inversion driving inverting the pixel voltage supply source with respect to the common electrode receiving the applied dc voltage every horizontal period is known as such a DC driving method, as disclosed in "Introduction to Liquid Crystal Display Engineering" by Yasoji Suzuki, The Daily Industrial News, Nov. 20, 1998, pp. 101-103. The liquid crystal display completes the operation of writing the video signal in all pixel portions arranged along a gate line every horizontal period.

FIG. 13 is a waveform diagram in a case of driving a liquid crystal display by the conventional line inversion driving method. Referring to FIG. 13, a pixel voltage supply source (video signal) VIDEO is inverted with respect to the voltage supply source COM of a common electrode every horizontal period, in order to drive the liquid crystal display by the conventional line inversion driving method. The pixel voltage supply source (video signal) VIDEO is varied with a displayed image every pixel portions A, B, C, D, E and F.

When the liquid crystal display is driven by the conventional line inversion driving method shown in FIG. 13 at a low frequency in order to reduce power consumption, however, flickering is disadvantageously easy to visually recognize. More specifically, a period for holding the pixel voltage supply source is increased when the liquid crystal display is driven at a low frequency, to remarkably fluctuate the pixel voltage supply source. When the pixel voltage supply source is remarkably fluctuated, the brightness of light passing through the pixel portions A to F deviates from a desired level, to cause flickering. In the conventional line inversion driving method, the aforementioned flickering linearly takes place to easily allow visual recognition.

In this regard, a liquid crystal display employing a dot inversion driving method of inverting a pixel voltage supply source (video signal) VIDEO with respect to the voltage supply source COM of a common electrode every adjacent pixel portions A and B, B and C, C and D, D and E or E and F is proposed in general.

FIG. 14 is a waveform diagram in a case of driving a liquid crystal display by a conventional dot inversion driving method. Referring to FIG. 14, a pixel voltage supply source (video signal) VIDEO responsive to a displayed image is inverted with respect to the voltage supply source COM of a common electrode every pixel portion A, B, C, D, E or F in order to drive the liquid crystal display by the conventional dot inversion driving method, dissimilarly to the conventional line inversion driving method shown in FIG. 13. When the liquid crystal display is driven by this conventional dot inversion driving method, flickering caused by low-frequency driving can be rendered hard to visually recognize since this flickering nonlinearly takes place.

A liquid crystal display capable of negatively/positively reversing images is known in general. This liquid crystal display negatively/positively reverses an image having a white background and black characters to that having a black background and white characters, for example. The liquid crystal display capable of negatively/positively reversing images performs negative/positive reversing by inverting a video signal in a driver IC driving/controlling the liquid crystal display. More specifically, the liquid crystal display inverts the respective bits of a 6-bit video signal, for example, by a video signal inversion circuit including six inverter circuits provided in the driver IC. In general, the liquid crystal display capable of negatively/positively reversing images also displays the images by the aforementioned conventional dot inversion driving method.

However, the conventional dot inversion driving method shown in FIG. 14 requires a video signal having a voltage twice a liquid crystal driving voltage, in order to invert the pixel voltage supply source (video signal) VIDEO with respect to the voltage supply source COM of the common electrode receiving a dc voltage. Assuming that V1 represents the liquid crystal driving voltage in FIG. 14, for example, a video signal having a voltage V2 twice the liquid crystal driving voltage V1 is required in order to obtain the same liquid crystal driving voltage V1 before and after inverting the pixel voltage supply source (video signal) VIDEO with respect to the voltage supply source COM of the common electrode. Therefore, reduction of power consumption is disadvantageously limited also when the liquid crystal display is driven at a low frequency in order to reduce power consumption.

In order to negatively/positively reverse images in the aforementioned liquid crystal display employing the conventional dot inversion driving method, further, the driver IC must disadvantageously be provided therein with a video signal inversion circuit including inverter circuits of the same number as the bit number of the video signal. In order to negatively/positively reverse a 6-bit video signal, for example, the driver IC must include a video signal inversion circuit having six inverter circuits in order to invert the video signal, and hence the structure of the video signal inversion circuit is complicated and the driver IC remarkably consumes power when reversing the images.

SUMMARY OF THE INVENTION

The present invention has been proposed in order to solve the aforementioned problems, and an object of the present invention is to provide a display capable of rendering flickering hard to visually recognize, reducing power consumption and simplifying the structure of a circuit for negatively/positively reversing images.

In order to attain the aforementioned object, a display according to an aspect of the present invention comprises a plurality of drain lines and a plurality of gate lines arranged to intersect with each other, a first pixel portion and a second pixel portion each including a subsidiary capacitor having a first electrode connected to a pixel electrode and a second electrode, a first subsidiary capacitance line and a second subsidiary capacitance line connected to the second electrodes of the subsidiary capacitors of the first pixel portion and the second pixel portion respectively and a signal supply circuit including a plurality of signal supply circuit portions supplying either a first signal having a first voltage supply source or a second signal having a second voltage supply source for negatively/positively reversing an image to the first subsidiary capacitance line of the first pixel portion while supplying either a third signal having a third voltage supply source or a fourth signal having a fourth voltage supply source for negatively/positively reversing the image to the second subsidiary capacitance line of the second pixel portion. The display according to the present invention negatively/positively reverses an image having a white background and black characters to that having a black background and white characters, for example.

As hereinabove described, the display according to this aspect, provided with the first and second subsidiary capacitance lines connected to the second electrodes of the subsidiary capacitors of the first and second pixel portions respectively as well as the signal supply circuit including the plurality of signal supply circuit portions supplying the first and third signals having the first and third voltage supply sources to the first and second subsidiary capacitance lines of the first and second pixel portions respectively, can raise the voltage supply source of the second electrode of the subsidiary capacitor of the first pixel portion to a high level by supplying a high-level first signal to the second electrode of the subsidiary capacitor of the first pixel portion through the first subsidiary capacitance line assuming that the first and third voltage supply sources are at high and low levels respectively and the display supplies the first and third signals to the first and second subsidiary capacitance lines of the first and second pixel portions respectively. Further, the display can lower the voltage supply source of the second electrode of the subsidiary capacitor of the second pixel portion to a low level by supplying the low-level third signal to the second electrode of the subsidiary capacitor of the second pixel portion through the second subsidiary capacitance line. Thus, the display can set the pixel voltage supply source of the first pixel portion higher than that immediately after an operation of writing a high-level video signal in the first pixel portion by supplying the high-level first signal to the second electrode of the subsidiary capacitor of the first pixel portion after writing the video signal. Further, the display can set the pixel voltage supply source of the second pixel portion lower than that immediately after an operation of writing a low-level video signal in the second pixel portion by supplying the low-level third signal to the second electrode of the subsidiary capacitor of the second pixel portion after writing the video signal. Thus, the voltage of the video signal may not be increased, whereby the display can easily suppress increase of power consumption resulting from an increased voltage of the video signal. Consequently, power consumption can be reduced. Further, the display provided with the signal supply circuit including the plurality of signal supply circuit portions supplying the second and fourth signals having the second and fourth voltage supply sources for negatively/positively reversing the image to the first and second subsidiary capacitance lines of the first and second pixel portions respectively can supply the second and fourth signals to the first and second subsidiary capacitance lines respectively when negatively/positively reversing the image. Thus, the display can invert a high-level video signal of the first pixel portion by supplying a low-level second signal to the second electrode of the subsidiary capacitor of the first pixel portion after writing the high-level video signal in the first pixel portion, for example. Further, the display can invert a low-level video signal of the second pixel portion by supplying a high-level fourth signal to the second electrode of the subsidiary capacitor of the second pixel portion after writing the low-level video signal in the second pixel portion. Thus, the display capable of negatively/positively reversing the image without inverting the video signal may not invert the respective bits of a 6-bit video signal also when negatively/positively reversing the 6-bit video signal. Thus, a circuit for reversing the image can be more simplified and power consumption can be more reduced as compared with a case of inverting the respective bits of the 6-bit video signal. Further, the display can easily perform dot inversion driving of inverting the pixel voltage supply source (video signal) with respect to the voltage supply source of a common electrode every adjacent pixel portions by adjacently arranging the first and second pixel portions. In addition, the display can easily perform block inversion driving of inverting the pixel voltage supply source (video signal) with respect to the voltage supply source of the common electrode every plurality of pixel portions by constituting one block of only a plurality of first pixel portions while constituting another block of only a plurality of second pixel portions and adjacently arranging these blocks. The display, performing dot inversion driving or block inversion driving in the aforementioned manner so that no flickering linearly takes place dissimilarly to a case of performing line inversion driving of inverting the pixel voltage supply source (video signal) with respect to the voltage supply source of the common electrode every adjacent gate lines, can easily render flickering hard to visually recognize.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

An embodiment of the present invention is now described with reference to the drawings.

The structure of a liquid crystal display according to the embodiment of the present invention is described with reference to FIGS. 1 to 4. The liquid crystal display according to this embodiment is described as an example of the inventive display.

Figure 1:
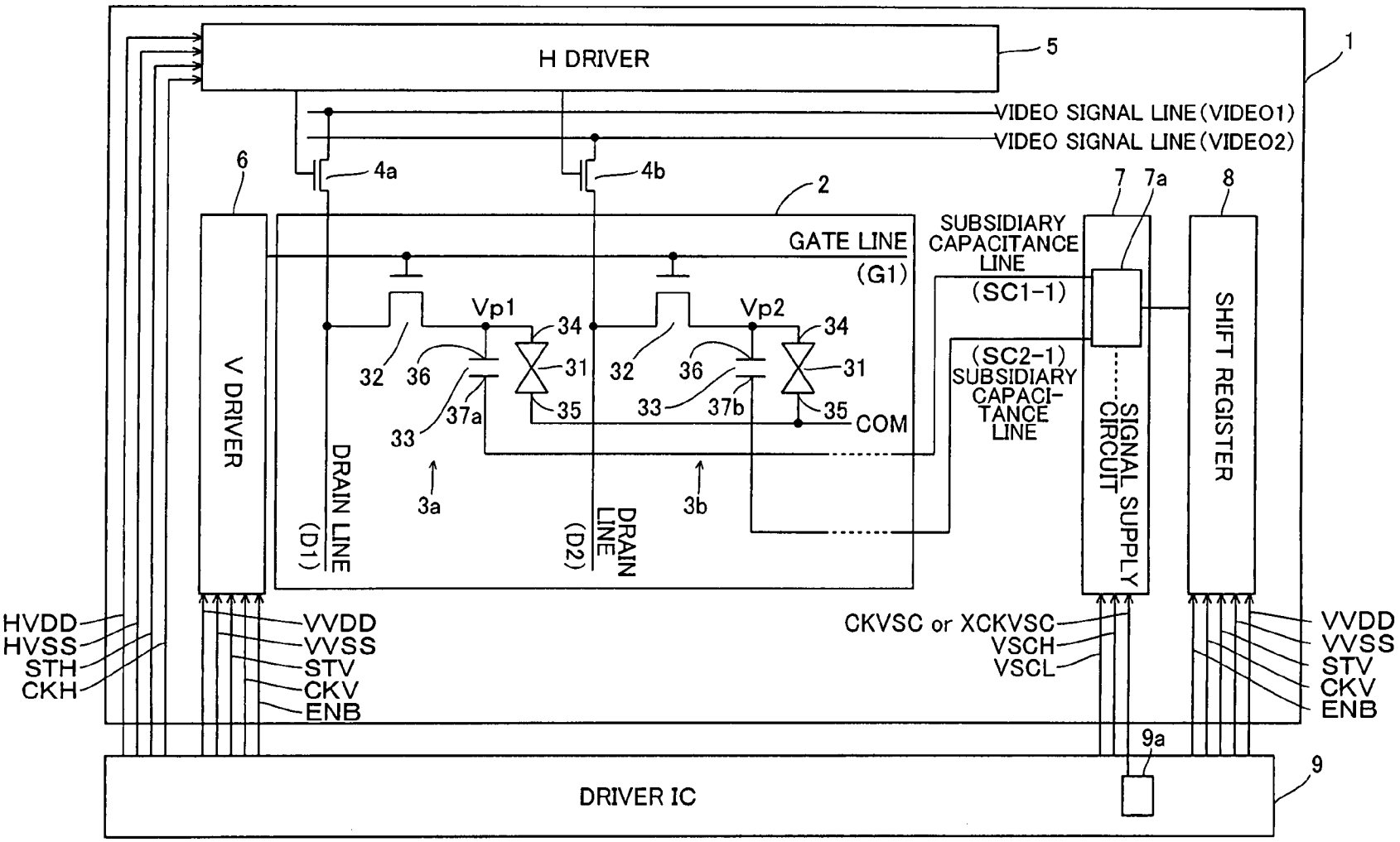
FIG. 1 is a plan view showing a liquid crystal display according to an embodiment of the present invention.

Referring to FIG. 1, a display portion 2 is provided on a substrate 1 in the liquid crystal display according to this embodiment. Pixel portions 3*a* and 3*b* are arranged on the display portion 2. While FIG. 1 shows only one gate line G1, two drain lines D1 and D2 intersecting with the gate line G1 and the two pixel portions 3*a* and 3*b* arranged along the gate line G1 in order to simplify the illustration, a plurality of gate lines and a plurality of drain lines are arranged to intersect with each other and a plurality of sets of pixel portions 3*a* and 3*b* are adjacently arranged in the form of a matrix in practice. The pixel portions 3*a* and 3*b* are examples of the "first pixel portion" and the "second pixel portion" in the present invention.

Each of the pixel portions 3*a* and 3*b* is constituted of a liquid crystal layer 31, an n-channel transistor 32 and a subsidiary capacitor 33. The liquid crystal layer 31 of each of the pixel portions 3*a* and 3*b* is arranged between a pixel electrode 34 and a common electrode (common electrode) 35.

The drains of the n-channel transistors 32 of the pixel portions 3*a* and 3*b* are connected to the drain lines D1 and D2 supplied with video signals respectively. The sources of the n-channel transistors 32 of the pixel portions 3*a* and 3*b* are connected to the pixel electrodes 34 respectively.

First electrodes 36 of the subsidiary capacitors 33 of the pixel portions 3*a* and 3*b* are connected to the pixel electrodes 34 respectively. Second electrodes 37*a* and 37*b* of the pixel portions 3*a* and 3*b* are connected to subsidiary capacitance lines SC1-1 and SC2-1 respectively. The electrodes 36 are examples of the "first electrode" in the present invention, and the electrodes 37*a* and 37*b* are examples of the "second electrode" in the present invention. The subsidiary capacitance lines SC1-1 and SC2-1 are examples of the "first subsidiary capacitance line" and the "second subsidiary capacitance line" respectively.

The substrate 1 is also provided thereon with n-channel transistors (H switches) 4*a* and 4*b* and an H driver 5 for driving (scanning) the drain lines D1 and D2 and subsequent drain lines (not shown). The n-channel transistors 4*a* and 4*b* corresponding to the pixel portions 3*a* and 3*b* (drain lines D1 and D2) are connected to video signal lines VIDEO1 and VIDEO2 respectively. A V driver 6 is also provided on the substrate 1 for driving (scanning) the first-stage gate line G1 and subsequent gate lines (not shown). The V driver 6 is an example of the "gate line driving circuit" or the "first shift register" in the present invention.

According to this embodiment, a signal supply circuit 7 and a shift register 8 are provided on the substrate 1. Both of the subsidiary capacitance lines SC1-1 and SC2-1 corresponding to the pixel portions 3*a* and 3*b* respectively are connected to the signal supply circuit 7 (signal supply circuit portion 7*a*). The signal supply circuit 7 has a function of alternately supplying high- and low-level signals VSCH and VSCL to the subsidiary capacitance lines SC1-1 and SC2-1 every frame period. The liquid crystal display completes the operation of writing video signals in all pixel portions 3*a* and 3*b* constituting the display portion 2 every frame period. The shift register 8 has a function of driving the signal supply circuit 7 for sequentially supplying the signals from the signal supply circuit 7 to the pair of subsidiary capacitance lines SC1-1 and SC2-1 provided along the first-stage gate line G1 up to a pair of subsidiary capacitance lines (not shown) provided along a final-stage gate line (not shown). The shift register 8 is an example of the "second shift register" in the present invention.

According to this embodiment, a driver IC 9 including a phase control circuit 9*a* is set outside the substrate 1. The driver IC 9 is an example of the "driving circuit" in the present invention. This driver IC 9 supplies a high voltage supply source HVDD, a low voltage supply source HVSS, a start signal STH and a clock signal CKH to the H driver 5. The driver IC 9 also supplies a higher voltage supply source VVDD, a lower voltage supply source VVSS, a start signal STV, a clock signal CKV and an enable signal ENB to the V driver 6. The driver IC 9 further supplies a higher voltage supply source VSCH and a lower voltage supply source VSCL to the signal supply circuit 7. The phase control circuit 9*a* supplies either a clock signal CKVSC or a clock signal XCKVSC for negatively/positively reversing an image to the signal supply circuit 7. The phase control circuit 9*a* generates the clock signal XCKVSC by inverting the phase of the clock signal CKVSC. The driver IC 9 supplies the shift register 8 with the same signals as those supplied to the V driver 6. The clock signal CKVSC is an example of the "first control signal" in the present invention, and the clock signal XCKVSC is an example of the "second control signal" in the present invention.

The internal structures of the V driver 6, the signal supply circuit 7 and the shift register 8 are described with reference to FIGS. 2 and 3. The V driver 6 includes shift register circuit portions 61*a* to 61*f*. The V driver 6 also includes AND circuit portions 62*a* to 62*e* each having three input terminals and an output terminal.

The input terminals of the AND circuit portion 62*a* receive output signals from the shift register circuit portions 61*a* and 61*b* and the enable signal ENB. The input terminals of the AND circuit portion 62*b* receive output signals from the shift register circuits 61*b* and 61*c* and the enable signal ENB. Similarly, input terminals of each of the subsequent AND circuit portions receive output signals from shift register circuit portions precedent and subsequent thereto and the enable signal ENB. Each of the AND circuit portions 62*a* to 62*e* outputs a high-level signal only when the three input signals go high, and outputs a low-level signal when any one of the three input signals is at a low level. The output terminals of the AND circuit portions 62*a* to 62*e* are connected to gate lines G1 to G5 respectively. Level shifter circuits (not shown) are connected between the AND circuit portions 62*a* to 62*e* and the gate lines G1 to G5.

The signal supply circuit 7 includes signal supply circuit portions 7*a* to 7*d*, which are provided in correspondence to the gate lines G1 to G4 respectively. FIGS. 2 and 3 illustrate no signal supply circuit portion corresponding to the gate line G5, in order to simplify the illustration.

Figure 3:
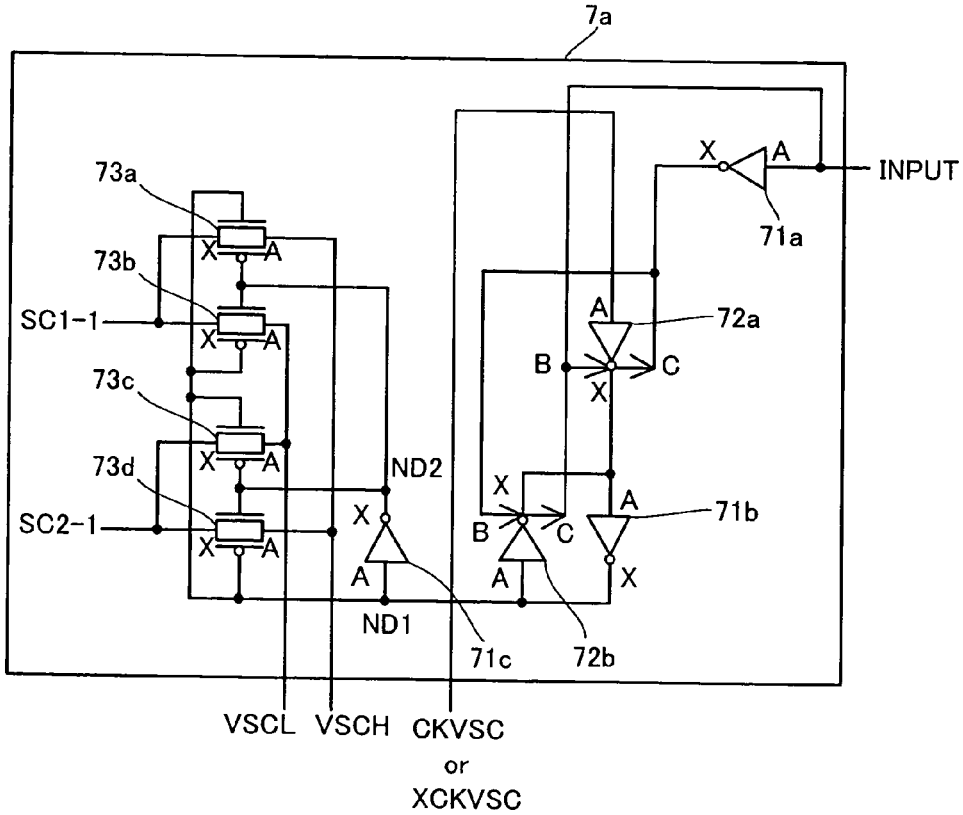
FIG. 3 is a circuit diagram showing a signal supply circuit portion of the liquid crystal display according to the embodiment of the present invention shown in FIGS. 1 and 2.

The signal supply circuit portion 7*a* is constituted of inverters 71*a* to 71*c*, clocked inverters 72*a* and 72*b* and switches 73*a* to 73*d*, as shown in FIG. 3 illustrating the detailed circuit structure thereof. Each of the switches 73*a* to 73*d* is constituted of an n-channel transistor and a p-channel transistor.

Figure 2:
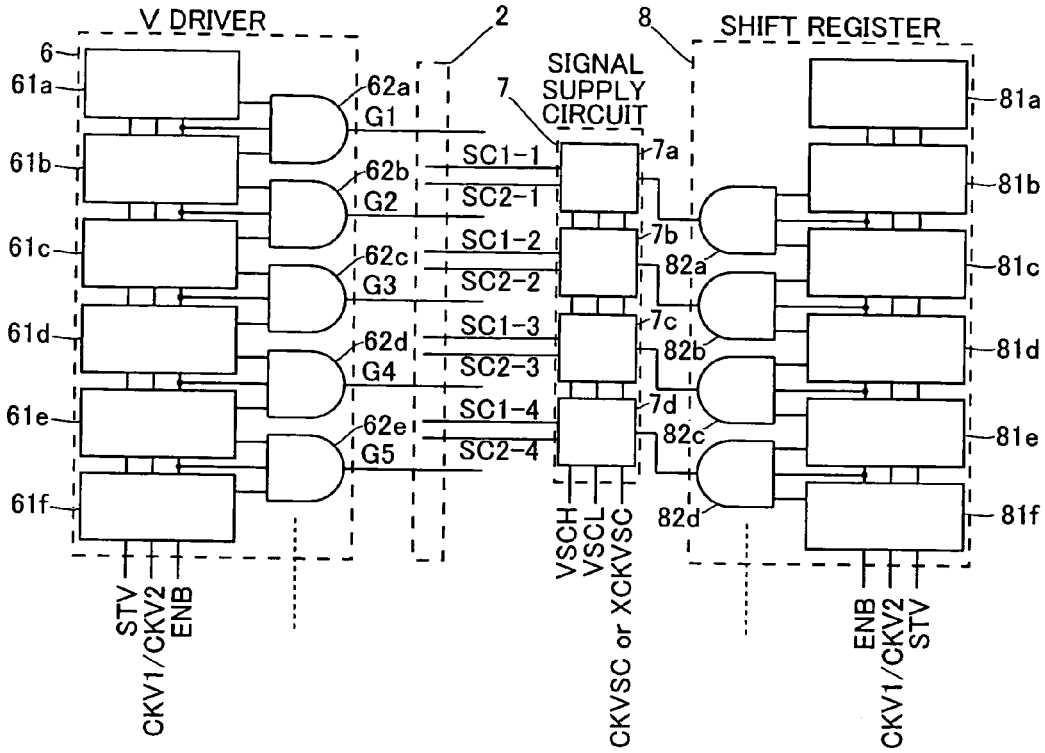
FIG. 2 is a block diagram of the liquid crystal display according to the embodiment of the present invention shown in FIG. 1.

An input terminal A of the inverter 71*a* receives an output signal from the shift register 8 (see FIG. 2). An input terminal B of the clocked inverter 72*a* also receives the output signal from the shift register 8, and another input terminal C of the clocked inverter 72*a* is connected to an output terminal X of the inverter 71*a*. Still another input terminal A of the clocked inverter 72*a* receives either the clock signal CKVSC or the clock signal XCKVSC, and an output terminal X of the clocked inverter 72*a* is connected to an input terminal A of the inverter 71*b*. An output terminal X of the inverter 71*b* is connected to a node ND1. An input terminal B of the clocked inverter 72*b* is connected to the output terminal X of the inverter 71*a*, and another input terminal C of the clocked inverter 72*c* receives the output signal from the shift register 8. Still another input terminal A of the clocked inverter 72*b* is connected to the node ND1, and an output terminal X of the clocked inverter 72*b* is connected to the input terminal A of the inverter 71*b*. An input terminal A of the inverter 71*c* is connected to the node ND1, and an output terminal X of the inverter 71*c* connected to another node ND2.

Input terminals A of the switches 73*a* and 73*d* and those of the switches 73*b* and 73*c* receive the positive and lower voltage supply sources VSCH and VSCL respectively. Output terminals X of the switches 73*a* and 73*b* and those of the switches 73*c* and 73*d* are connected to the subsidiary capacitance lines SC1-1 and SC2-1 respectively. The gates of the n-channel transistors of the switches 73*a* and 73*c* are connected to the node ND1, while those of the p-channel transistors of the switches 73*a* and 73*c* are connected to the node ND2. The gates of the n-channel transistors of the switches 73*b* and 73*d* are connected to the node ND2, while those of the p-channel transistors of the switches 73*b* and 73*d* are connected to the node ND1.

The circuit structures of the signal supply circuit portions 7*b* to 7*d* shown in FIG. 2 are similar to that of the signal supply circuit portion 7*a* except subsidiary capacitance lines connected thereto and shift register circuit portions, described below, connected thereto.

As shown in FIG. 2, the shift register 8 includes shift register circuit portions 81*a* to 81*f*. The shift register circuit portions 81*a* to 81*f* may be similar in circuit structure to the shift register circuit portions 61*a* to 61*f* of the V driver 6 respectively. The shift register 8 also includes AND circuit portions 82*a* to 82*d* each having three input terminals and an output terminal.

The input terminals of the AND circuit portion 82*a* receive output signals from the shift register circuit portions 81*a* and 81*b* and the enable signal ENB. The input terminals of the AND circuit portion 82*b* receive output signals from the shift register circuits 81*b* and 81*c* and the enable signal ENB. Similarly, the input terminals of each of the subsequent AND circuit portions receive output signals from shift register circuit portions precedent and subsequent thereto and the enable signal ENB. The output terminals of the AND circuit portions 82*a* to 82*e* are connected to the signal supply circuit portions 7*a* to 7*d* respectively. The shift register 8 is provided with no AND circuit portion receiving output signals from the shift register circuit portions 81*a* and 81*b*, dissimilarly to the V driver 6, for the following reason: The shift register 8 receives the start signal STV, the clock signal CKV and the enable signal ENB identically to the V driver 6. In order to fluctuate the voltage supply source of the first-stage subsidiary capacitor after writing a video signal in the first-stage pixel portion, therefore, it is necessary to fluctuate this voltage supply source in response to a high-level signal of the second-stage AND circuit portion. Therefore, the shift register 8 requires no first-stage AND circuit portion receiving the output signals from the shift register circuit portions 81*a* and 81*b*.

Figure 4:
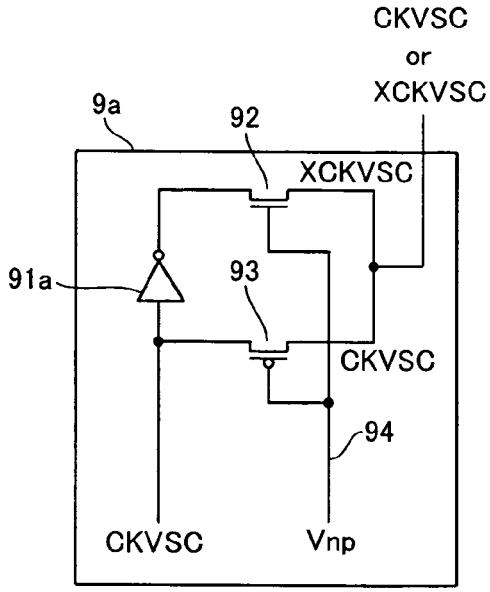
FIG. 4 is a circuit diagram showing a phase control circuit of a driver IC of the liquid crystal display according to the embodiment of the present invention shown in FIG. 1.

The circuit structure of the phase control circuit 9*a* of the driver IC 9 (see FIG. 1) is described with reference to FIGS. 1 and 4. As shown in FIG. 4, the phase control circuit 9*a* includes an inverter 91*a* for inverting the clock signal CKVSC, an n-channel transistor 92 and a p-channel transistor 93. The input terminal of the inverter 91*a* receives the clock signal CKVSC, and is connected with either the source or the drain of the p-channel transistor 93. The output terminal of the inverter 91*a* is connected to either the source or the drain of the n-channel transistor 92. A phase control signal line 94 for inputting a phase control signal Vnp is connected to the gates of the n-channel transistor 92 and the p-channel transistor 93. Either the drains or the sources of the n-channel transistor 92 and the p-channel transistor 93, which are connected with each other, are connected to the signal supply circuit 7 (see FIG. 1).

Figure 5:
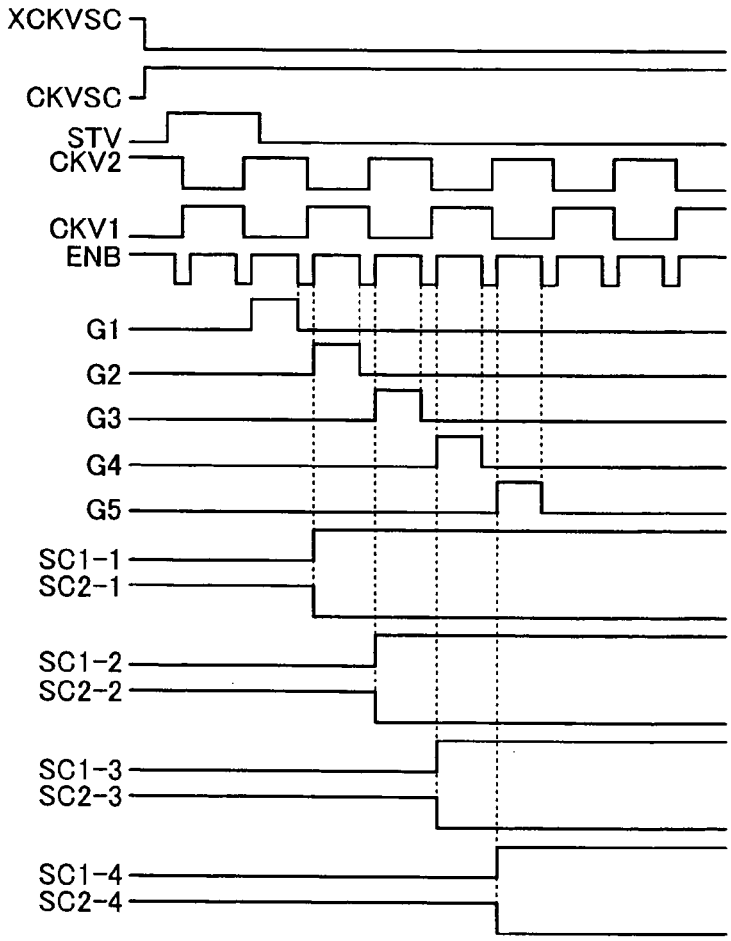
FIG. 5 is a timing chart for illustrating operations of a V driver, a signal supply circuit and a shift register for displaying an image in a normal (nonreversed) state in the liquid crystal display according to the embodiment of the present invention shown in FIG. 2.

FIG. 5 a timing chart for illustrating operations of the V driver 6, the signal supply circuit 7 and the shift register 8 for displaying an image in a normal (nonreversed) state in the liquid crystal display according to the embodiment of the present invention shown in FIG. 2. FIGS. 6 to 12 are diagrams for illustrating operations of the pixel portions 3*a* and 3*b* of the liquid crystal display according to the embodiment of the present invention shown in FIG. 1. The operations of the liquid crystal display according to the embodiment of the present invention are now described with reference to FIGS. 1 to 12.

In order to display the image in the normal (nonreversed) state, the liquid crystal display inputs a high-level start signal STV in the V driver 6 and the shift register 8 shown in FIG. 2, as shown in FIG. 5. Then, a clock signal CKV1 goes high in the V driver 6 (see FIG. 2), so that the AND circuit portion 62*a* receives a high-level signal from the shift register circuit portion 61*a*. Thereafter the clock signal CKV1 goes low and a clock signal CKV2 goes high, so that the AND circuit portions 62*a* and 62*b* receive a high-level signal from the shift register circuit portion 61*b*. Then, the enable signal ENB goes high so that all three signals (signals from the shift register circuit portions 61*a* and 61*b* and the enable signal ENB) input in the AND circuit portion 62*a* also go high, whereby the gate line G1 is supplied with a high-level signal from the AND circuit portion 62*a*. Then, the enable signal ENB goes low so that the AND circuit portion 62*a* supplies the gate line G1 with a low-level signal, which is held at the low level for one frame period. Thereafter the clock signal CKV2 goes low.

Then, the clock signal CKV1 goes high again so that the AND circuit portions 62*b* and 62*c* receive a high-level signal from the shift register circuit portion 61*c* (see FIG. 2). Then, the enable signal ENB goes high again so that all three signals (signals from the shift register circuit portions 61*b* and 61*c* and the enable signal ENB) input in the AND circuit portion 62*b* also go high, whereby the AND circuit portion 62*b* supplies the gate line G2 with a high-level signal. Then, the enable signal ENB goes low, so that the AND circuit portion 62*b* supplies the gate line G2 with a low-level signal, which in turn is held at the low level for one frame period. Thereafter the clock signal CKV1 goes low.

Then, the liquid crystal display sequentially inputs high-level signals from the shift register circuit portions 61*d* to 61*f* (see FIG. 2) in the AND circuit portions 62*c* to 62*e* in synchronization with the clock signals CKV1 and CKV2, similarly to the aforementioned operation on the AND circuit portions 62*a* and 62*b*. Thus, the liquid crystal display sequentially supplies the high-level signals from the AND circuit portions 62*c* to 62*e* to the gate lines G3 to G5 in synchronization with the enable signal ENB, similarly to the aforementioned operation on the gate lines G1 and G2. Thereafter the liquid crystal display sequentially supplies low-level signals from the AND circuit portions 62*c* to 62*e* to the gate lines G3 to G5 in synchronization with the enable signal ENB, and holds the same at the low levels for one frame period. The liquid crystal display forcibly sets the gate lines G1 to G5 low while the enable signal ENB is at a low level, not to overlap high-level periods of adjacent gate lines with each other.

Also in the shift register 8 (AND circuit portions 82*a* to 82*d*: see FIG. 2), the liquid crystal display sequentially inputs high-level signals from the shift register circuit portions 81*b* (81*a*) to 81*f* in the AND circuit portions 82*a* to 82*d* in synchronization with the clock signals CKV1 and CKV2 similarly to the aforementioned operation on the AND circuit portions 62*a* to 62*e*. Thus, the AND circuit portions 82*a* to 82*d* sequentially output high-level signals in synchronization with the enable signal ENB. The shift register 8 sequentially outputs high-level signals in the aforementioned manner, at timing similar to the timing for supplying high-level signals to the gate lines G2 to G5.

The liquid crystal display sequentially inputs the high-level signals sequentially output from the shift register 8 in the signal supply circuit portions 7*a* to 7*d* (see FIG. 2) of the signal supply circuit 7.

In the phase control circuit 9*a* of the driver IC 9, the inverter 91*a* receives a high-level clock signal CKVSC in its input terminal and outputs a low-level clock signal CKVSC from its output terminal, as shown in FIG. 4. In the nonreversed (normal) case, the n-channel transistor 92 and the p-channel transistor 93 receive a low-level phase control signal Vnp in the gates thereof through the phase control signal line 94. Thus, the n-channel transistor 92 and the p-channel transistor 93 enter OFF- and ON-states respectively, so that the phase control circuit 9*a* supplies the signal supply circuit 7 with a high-level clock signal CKVSC, which is a control signal for making the signal supply circuit 7*a* perform normal (nonreversed) display.

In the signal supply circuit portion 7*a*, the clocked inverter 72*a* enters an ON-state when receiving a high-level input signal from the shift register 8 (see FIG. 1), as shown in FIG. 3. In the case of normal (nonreversed) display, the clocked inverter 72*a*, receiving the high-level clock signal CKVSC from the phase control circuit 9*a* of the driver IC 9 in its input terminal A, outputs a low-level signal from its output terminal X. The inverter 71*b* inverts this low-level signal to a high level. Therefore, the node ND1 goes high while the node ND2 goes low through the inverter 71*c*. Thus, the switches 73*a* and 73*c* enter ON-states while the switches 73*b* and 73*d* enter OFF-states. Consequently, the subsidiary capacitance lines SC1-1 and SC2-1 are supplied with the high-level signal VSCH and the low-level signal VSCL respectively.

When the input signals from the shift register 8 go low, the clocked inverters 72*a* and 72*b* enter OFF- and ON-states respectively, whereby the inverter 71*b* continuously receives the low-level signal in its input terminal A. Consequently, the liquid crystal display holds the nodes ND1 and ND2 at the high and low levels respectively, thereby continuously supplying the high- and low-level signals VSCH and VSCL to the subsidiary capacitance lines SCd-1 and SC2-1 respectively. Also in the signal supply circuit portions 7*b* to 7*d* shown in FIG. 2, the liquid crystal display performs operations similar to that in the signal supply circuit portion 7*a*.

Thus, the liquid crystal display sequentially supplies the high- and low-level signals VSCH and VSCL from the signal supply circuit portions 7*a* to 7*d* to the subsidiary capacitance lines SC1-1 to SC1-4 and SC2-1 to SC2-4 at timing similar to that for supplying high-level signals to the gate lines G2 to G5. The subsidiary capacitance lines SC1-2, SC1-3 and SC1-4 are examples of the "first subsidiary capacitance line" in the present invention, and the subsidiary capacitance lines SC2-2, SC2-3 and SC2-4 are examples of the "second subsidiary capacitance line" in the present invention.

In the display portion 2 shown in FIG. 1, the liquid crystal display operates as follows, for example: First, the liquid crystal display supplies high- and low-level video signals to the video signal lines VIDEO0 and VIDEO2 respectively. The H driver 5 sequentially supplies high-level signals to the gates of the n-channel transistors 4*a* and 4*b*, thereby sequentially turning on the n-channel transistors 4*a* and 4*b*. Thus, the liquid crystal display supplies the high- and low-level video signals from the video signal lines VIDEO0 and VIDEO2 to the drain lines D1 and D2 of the pixel portions 3*a* and 3*b* respectively. Thereafter the liquid crystal display supplies a high-level signal to the gate line G1, as described above.

Figure 6:
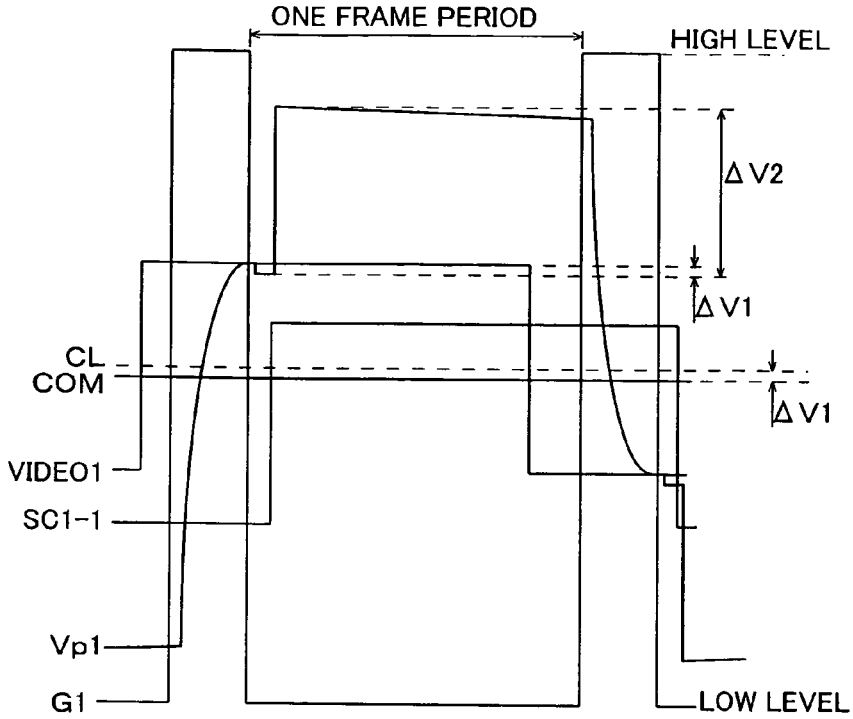
FIGS. 6 and 7 are waveform diagrams for illustrating operations of pixel portions for displaying the image in the normal (nonreversed) state in the liquid crystal display according to the embodiment of the present invention shown in FIG. 1.

At this time, the liquid crystal display turns on the n-channel transistor 32 in the pixel portion 3*a*, thereby writing the high-level video signal in the pixel portion 3*a*. In other words, a pixel voltage supply source Vp1 goes up to the level of the video signal line VIDEO1, as shown in FIG. 6. Then, the signal supplied to the gate line G1 goes low, thereby turning off the n-channel transistor 32 (see FIG. 1). Thus, the liquid crystal display completes the operation of writing the high-level video signal in the pixel portion 3*a*. At this time, the pixel voltage supply source Vp1 goes down by ΔV1 due to the low-level signal supplied to the gate line G1. The voltage supply source COM of the common electrode 35 is previously set to a level lower than the center level CL of the voltage supply source of the video signal line VIDEO1 by ΔV1 in consideration of the fall of the pixel voltage supply source Vp1 by ΔV1.

According to this embodiment, the liquid crystal display supplies the high-level signal VSCH to the subsidiary capacitance line SC1-1 after the signal supplied to the gate line G1 goes low, thereby supplying the high-level signal VSCH to the second electrode 37*a* of the subsidiary capacitor 33 (see FIG. 1) and raising the voltage supply source of the subsidiary capacitor 33 to a high level. Thus, the liquid crystal display distributes charges between the liquid crystal layer 31 and the subsidiary capacitor 33, thereby raising the pixel voltage supply source Vp1 by ΔV2. The liquid crystal display holds the pixel voltage supply source Vp1 raised by ΔV2 for one frame period (until the n-channel transistor 32 reenters an ON-state). The pixel voltage supply source Vp1 slightly fluctuates with time due to influence by a leakage current or the like.

Figure 7:
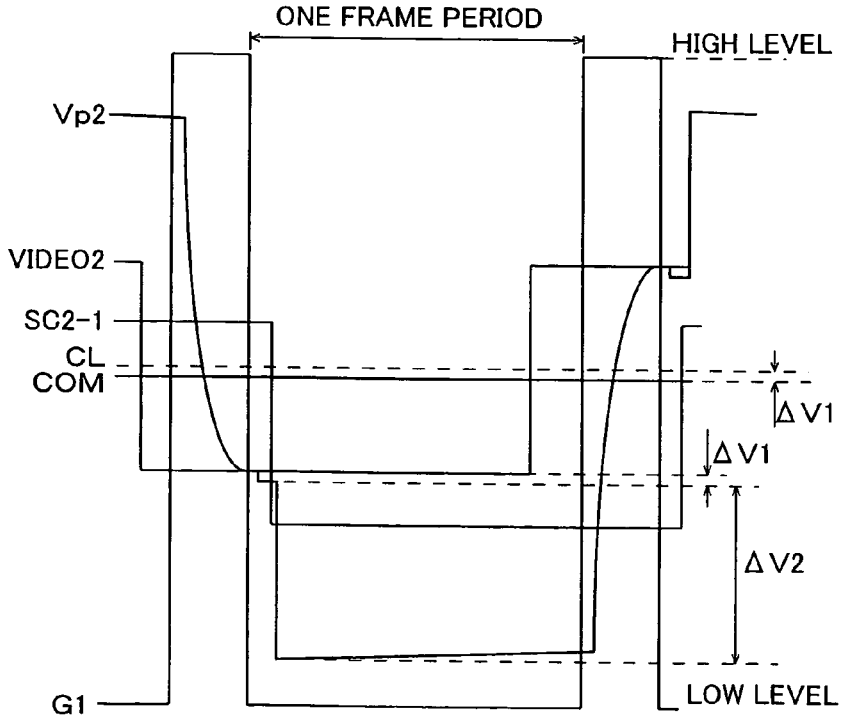

The liquid crystal display turns on the n-channel transistor 32 in the pixel portion 3*b* (see FIG. 1), thereby writing the low-level video signal in the pixel portion 3*b*. In other words, a pixel voltage supply source Vp2 goes down to the level of the video signal line VIDEO2, as shown in FIG. 7. Then, the signal supplied to the gate line G1 goes low, thereby turning off the n-channel transistor 32. Thus, the liquid crystal display completes the operation of writing the low-level video signal in the pixel portion 3*b*, and the pixel voltage supply source Vp2 goes down by ΔV1. The liquid crystal display supplies the low-level signal VSCL to the subsidiary capacitance line SC2-1 after the signal supplied to the gate line G1 goes low, thereby supplying the low-level signal to the second electrode 37*b* (see FIG. 1) of the subsidiary capacitor 33 and lowering the voltage supply source of the subsidiary capacitance 33. Thus, the liquid crystal display lowers the pixel voltage supply source Vp2 by ΔV2, and holds the pixel voltage supply source Vp2 lowered by ΔV2 for one frame period.

Also in the pixel portions arranged along the second- to fifth-stage gate lines G2 to G5 (see FIG. 2), the liquid crystal display sequentially performs operations similar to those on the pixel portions 3*a* and 3*b* arranged along the first-stage gate line G1. After completing first-frame operations, the liquid crystal display inverts the video signals supplied to the video signal lines VIDEO0 and VIDEO2 to low and high levels with respect to the voltage supply source COM of the common electrode 35 respectively.

Then, the liquid crystal display switches the clock signal CKVSC supplied from the phase control circuit 9*a* of the driver IC 9 to the signal supply circuit 7 in the nonreversed (normal) case to a low level. In this case, the switches 83*a* and 83*c* enter OFF-states and the switches 73*b* and 73*d* enter ON-states in the signal supply circuit portion 7*a* receiving the low-level clock signal CKVSC in its input terminal A as shown in FIG. 3, contrarily to the case of the high-level clock signal CKVSC. Consequently, the liquid crystal display supplies the low- and high-level signals VSCL and VSCH to the subsidiary capacitance lines SC1-1 and SC2-1 respectively. Also in the signal supply circuit portions 7*b* to 7*d* (see FIG. 2), the liquid crystal display performs operations similar to that in the signal supply circuit portion 7*a*.

Thus, the liquid crystal display performs the operations shown in FIGS. 7 and 6 in the pixel portions 3*a* and 3*b* respectively in a second frame. Also in third and subsequent frames, the liquid crystal display alternately switches the video signals supplied to the video signal lines VIDEO1 and VIDEO2 (see FIG. 1) between high and low levels and between low and high levels respectively every frame period. The liquid crystal display further alternately switches the clock signal CKVSC supplied to the signal supply circuit 7 between high and low levels, thereby alternately switching the high- and low-level signals VSCH and VSCL supplied to the subsidiary capacitance lines SC1-1 to SC1-4 and SC2-1 to SC2-4 (see FIG. 2) respectively.

Figure 8:
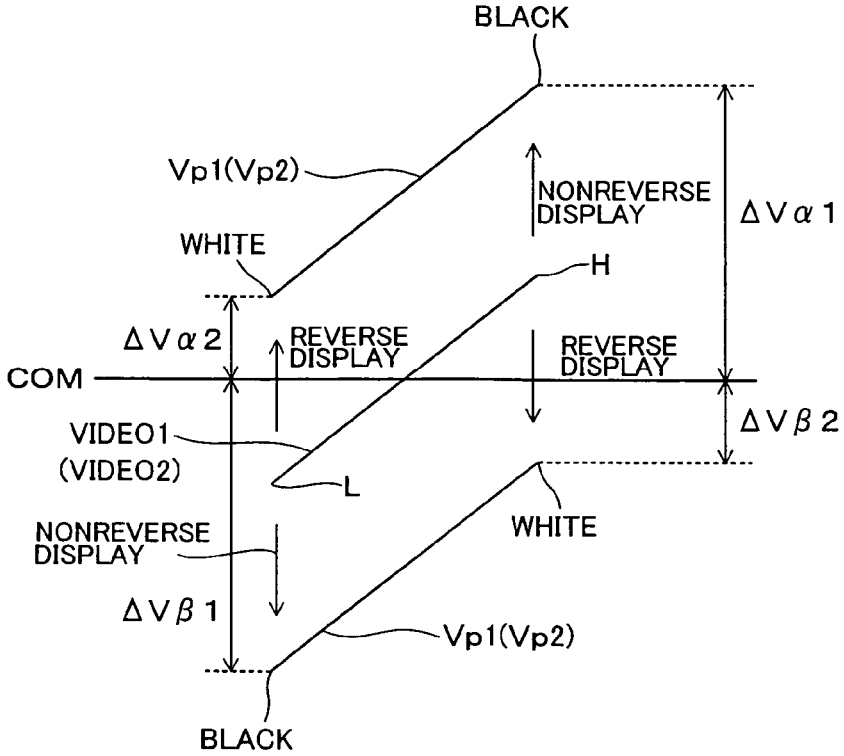
FIG. 8 is a diagram for illustrating operations of the pixel portions of the liquid crystal display according to the embodiment of the present invention shown in FIG. 1.
Figure 9:
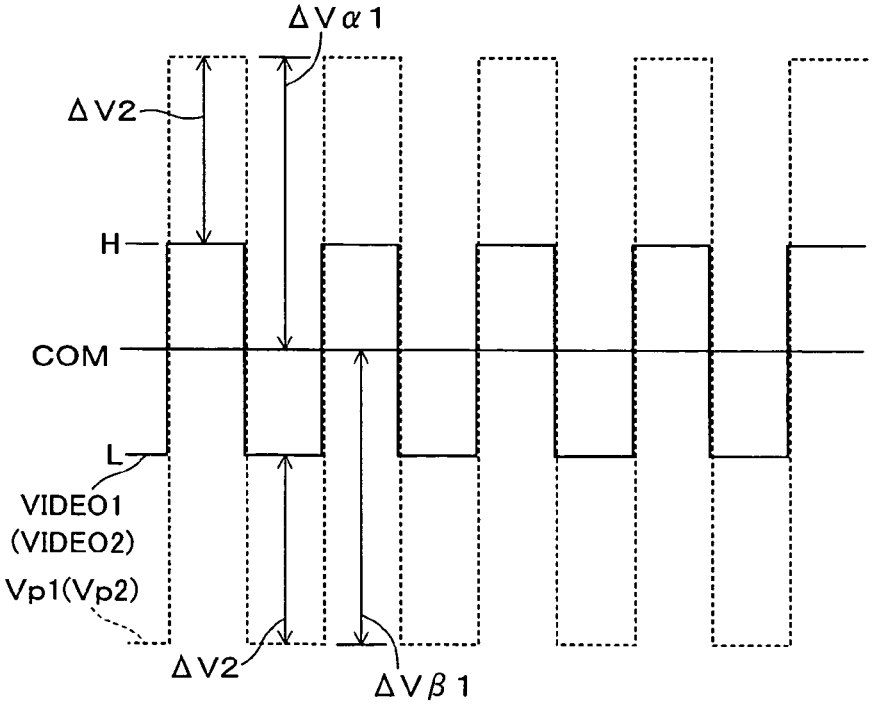
FIG. 9 is a schematic waveform diagram for illustrating operations of the pixel portions for displaying the image in the normal (nonreversed) state in the liquid crystal display according to the embodiment of the present invention shown in FIG. 1.

According to this embodiment, as hereinabove described, the liquid crystal display supplies the high-level signal VSCH to the subsidiary capacitance line SC1-1 when the voltage supply source of the video signal line VIDEO0 supplied to the pixel voltage supply source Vp1 of the pixel portion 3*a* (see FIG. 1) is at a high level as shown in FIGS. 8 and 9, in order to display an image in a normal (nonreversed) state. Thus, the liquid crystal display increases the difference ΔVα1 between the pixel voltage supply source Vp1 and the voltage supply source COM of the common electrode 35 (see FIG. 1), thereby displaying the pixel portion 3*a* in black (see FIG. 8), for example, in a normally white case. When the voltage supply source of the video signal line VIDEO1 supplied to the pixel voltage supply source Vp1 of the pixel portion 3*a* is at a low level, on the other hand, the liquid crystal display supplies the low-level signal VSCL to the subsidiary capacitance line SC1-1. Thus, the liquid crystal display increases the difference ΔVβ1 between the pixel voltage supply source Vp1 and the voltage supply source COM of the common electrode 35 (see FIG. 1), thereby displaying the pixel portion 3*a* in black (see FIG. 8), for example, in the normally white case. When the voltage supply source of the video signal VIDEO2 supplied to the pixel voltage supply source Vp2 of the pixel portion 3*b* (see FIG. 1) is at a low level, the liquid crystal display supplies the low-level signal VSCL to the subsidiary capacitance line SC2-1. Thus, the liquid crystal display increases the difference ΔVβ1 between the pixel voltage supply source Vp1 and the voltage supply source COM of the common electrode 35 (see FIG. 1), thereby displaying the pixel portion 3*b* in black (see FIG. 8), for example, in a normally white case. When the voltage supply source of the video signal line VIDEO2 supplied to the pixel voltage supply source Vp2 of the pixel portion 3*b* is at a high level, on the other hand, the liquid crystal display supplies the high-level signal VSCH to the subsidiary capacitance line SC2-1. Thus, the liquid crystal display increases the difference ΔVα1 between the pixel voltage supply source Vp2 and the voltage supply source COM of the common electrode 35 (see FIG. 1), thereby displaying the pixel portion 3*b* in black (see FIG. 8), for example, in a normally white case.

Figure 10:
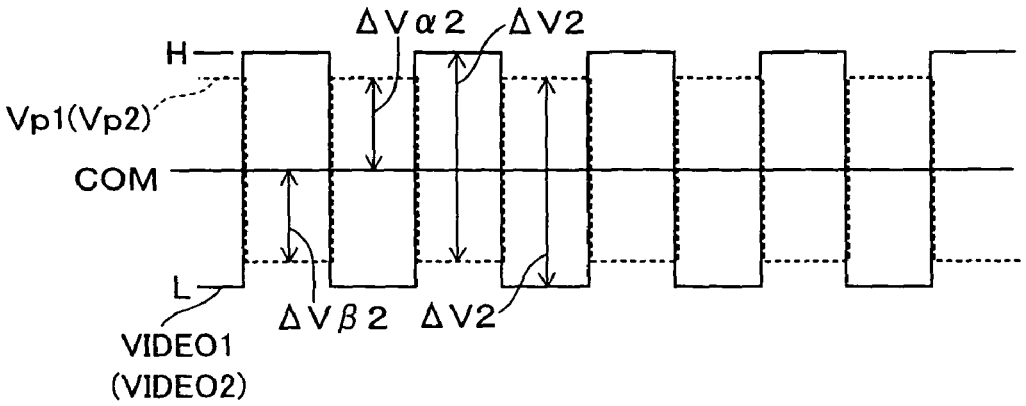
FIGS. 10 to 12 are schematic waveform diagrams for illustrating operations of the pixel portions for reversing the image in the liquid crystal display according to the embodiment of the present invention shown in FIG. 1.

In order to negatively/positively reverse the image according to this embodiment, the liquid crystal display supplies the low-level signal VSCL to the subsidiary capacitance line SC1-1 when the voltage supply source of the video signal line VIDEO0 supplied to the pixel voltage supply source Vp1 of the pixel portion 3*a* (see FIG. 1) is at a high level, as shown in FIGS. 8 and 10. Thus, the liquid crystal display reduces the difference ΔVβ2 between the pixel voltage supply source Vp1 and the voltage supply source COM of the common electrode 35 (see FIG. 1), thereby displaying the pixel portion 3*a* in white (see FIG. 8), for example, in the normally white case. When the voltage supply source of the video signal line VIDEO1 supplied to the pixel voltage supply source Vp1 of the pixel portion 3*a* (see FIG. 1) is at a low level, on the other hand, the liquid crystal display supplies the high-level signal VSCH to the subsidiary capacitance line SC1-1. Thus, the liquid crystal display reduces the difference ΔVα2 between the pixel voltage supply source Vp1 and the voltage supply source COM of the common electrode 35 (see FIG. 1), thereby displaying the pixel portion 3*a* in white (see FIG. 8), for example, in the normally white case. When the voltage supply source of the video signal line VIDEO2 supplied to the pixel voltage supply source Vp2 of the pixel portion 3*b* (see FIG. 1) is at a low level, the liquid crystal display supplies the high-level signal VSCH to the subsidiary capacitance line SC2-1. Thus, the liquid crystal display reduces the difference ΔVα2 between the pixel voltage supply source Vp2 and the voltage supply source COM of the common electrode 35 (see FIG. 1), thereby displaying the pixel portion 3*b* in white (see FIG. 8), for example, in the normally white case. When the voltage supply source of the video signal line VIDEO2 supplied to the pixel voltage supply source Vp2 of the pixel portion 3*b* is at a high level, on the other hand, the liquid crystal display supplies the low-level signal VSCL to the subsidiary capacitance line SC2-1. Thus, the liquid crystal display reduces the difference ΔVβ2 between the pixel voltage supply source Vp2 and the voltage supply source COM of the common electrode 35 (see FIG. 1), thereby displaying the pixel portion 3*b* in white (see FIG. 8), for example, in the normally white case.

Operations of the liquid crystal display for negatively/positively reversing the image are now described in detail. First, operations of the V driver 6 and the shift register 8 are similar to those for displaying the image in the normal (non-reversed) state. As shown in FIG. 1, the phase control circuit 9*a* of the driver IC 9 supplies the clock signal XCKVSC for negatively/positively reversing the image to the signal supply circuit portion 7*a* of the signal supply circuit 7. More specifically, the inverter 91*a* receives a high-level clock signal XCKVSC in its input terminal and outputs a low-level clock signal CKVSC from its output terminal in the phase control circuit 9*a* of the driver IC 9, as shown in FIG. 4. In the case of negatively/positively reversing the image, the liquid crystal display inputs a high-level phase control signal Vnp in the gates of the n-channel transistor 92 and the p-channel transistor 93 through the phase control signal line 94. Thus, the liquid crystal display turns n-channel transistor 92 and the p-channel transistor 93 on and off respectively, thereby supplying the low-level clock signal XCKVSC serving as a control signal for making the signal supply circuit portion 7*a* negatively/positively reverse the image from the phase control circuit 9*a* to the signal supply circuit 7.

When the signal supply circuit portion 7*a* receives a high-level input signal from the shift register 8 (see FIG. 1) as shown in FIG. 3, the clocked inverter 72*a* enters an ON-state. In the case of the reversed (negatively/positively reversed) display, the clocked inverter 72 receiving the low-level clock signal XCKVSC in its input terminal A from the phase control circuit 9*a* of the driver IC 9 outputs a high-level signal from its output terminal X. The inverter 71*b* inverts this high-level signal to a low level. Therefore, the node ND1 goes low, while the node ND2 goes high through the inverter 71*c*. Thus, the switches 73*a* and 73*c* enter OFF-states, and the switches 73*b* and 73*d* enter ON-states. Consequently, the liquid crystal display supplies the low- and high-level signals VSCL and VSCH to the subsidiary capacitance lines SC1-1 and SC2-1 respectively.

When the input signal from the shift register 8 goes low, the clocked inverter 72*a* enters an OFF-state, while the clocked inverter 72*b* enters an ON-state and hence the inverter 71*b* continuously receives the high-level signal in its input terminal A. Consequently, the liquid crystal display continuously holds the nodes ND1 and ND2 at the low and high levels respectively, thereby continuously supplying the low- and high-level signals VSCL and VSCH to the subsidiary capacitance lines SC1-1 and SC2-1 respectively. Also in the signal supply circuit portions 7*b* to 7*d* shown in FIG. 2, the liquid crystal display performs operations similar to those on the signal supply circuit portion 7*a*.

Thus, the liquid crystal display sequentially supplies the low- and high-level signals VSCL and VSCH from the signal supply circuit portions 7*a* to 7*d* to the subsidiary capacitance lines SC1-1 to SC1-4 and SC2-1 to SC2-4 respectively at timing similar to that for supplying the high-level signals to the gate lines G2 to G5.

In the display portion 2 shown in FIG. 1, the liquid crystal display operates as follows, for example: First, the liquid crystal display supplies high- and low-level video signals to the video signal lines VIDEO1 and VIDEO2 respectively. Then, the liquid crystal display sequentially supplies a high-level signal from the H driver 5 to the gates of the n-channel transistors 4*a* and 4*b*, thereby sequentially turning on the n-channel transistors 4*a* and 4*b*. Thus, the liquid crystal display supplies the high- and low-level video signals from the video signal lines VIDEO1 and VIDEO2 to the drain lines D1 and D2 of the pixel portions 3*a* and 3*b* respectively. According to this embodiment, the liquid crystal display supplies noninverted video signals to the video signal lines VIDEO1 and VIDEO2 and the drain lines D1 and D2 also in the case of reversed (negatively/positively reversed) display. Thereafter the liquid crystal display supplies the high-level signal to the gate line G1 as described above.

Figure 11:
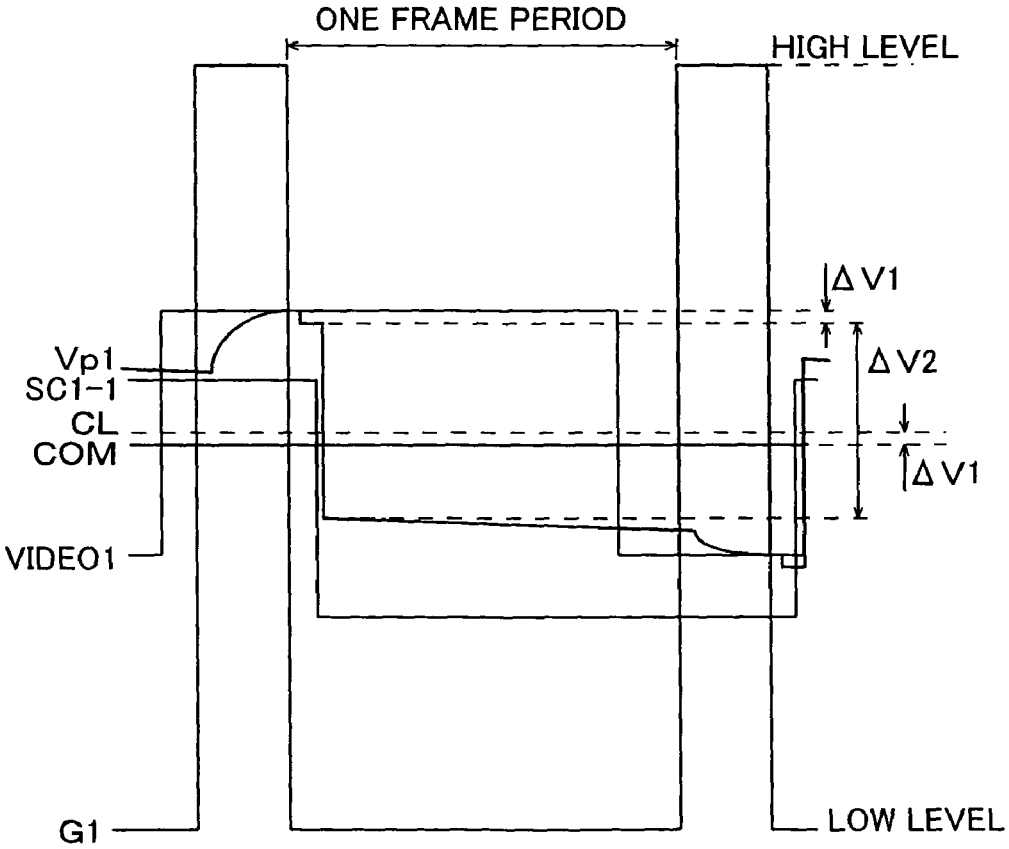

At this time, the liquid crystal display turns on the n-channel transistor 32 in the pixel portion 3*a*, thereby writing the high-level video signal in the pixel portion 3*a*. In other words, the pixel voltage supply source Vp1 goes up to the level of the video signal line VIDEO, as shown in FIG. 11. Then, the signal supplied to the gate line G1 goes low, thereby turning off the n-channel transistor 32 (see FIG. 1). Thus, the liquid crystal display completes the operation of writing the high-level video signal in the pixel portion 3*a* (see FIG. 1). At this time, the pixel voltage supply source Vp1 goes down by ΔV1 due to the low level of the signal supplied to the gate line G1.

According to this embodiment, the liquid crystal display supplies the low-level signal VSCL to the subsidiary capacitance line SC1-1 after the signal supplied to the gate line G1 goes low, thereby supplying the low-level signal VSCL to the second electrode 37*a* (see FIG. 1) of the subsidiary capacitor 33 and lowering the voltage supply source of the subsidiary capacitor 33. Thus, the liquid crystal display redistributes charges between the liquid crystal layer 31 (see FIG. 1) and the subsidiary capacitor 33, thereby lowering the pixel voltage supply source Vp1 by ΔV2. The liquid crystal display holds the pixel voltage supply source Vp1 lowered by ΔV2 for one frame period (until the n-channel transistor 32 reenters an ON-state).

Figure 12:
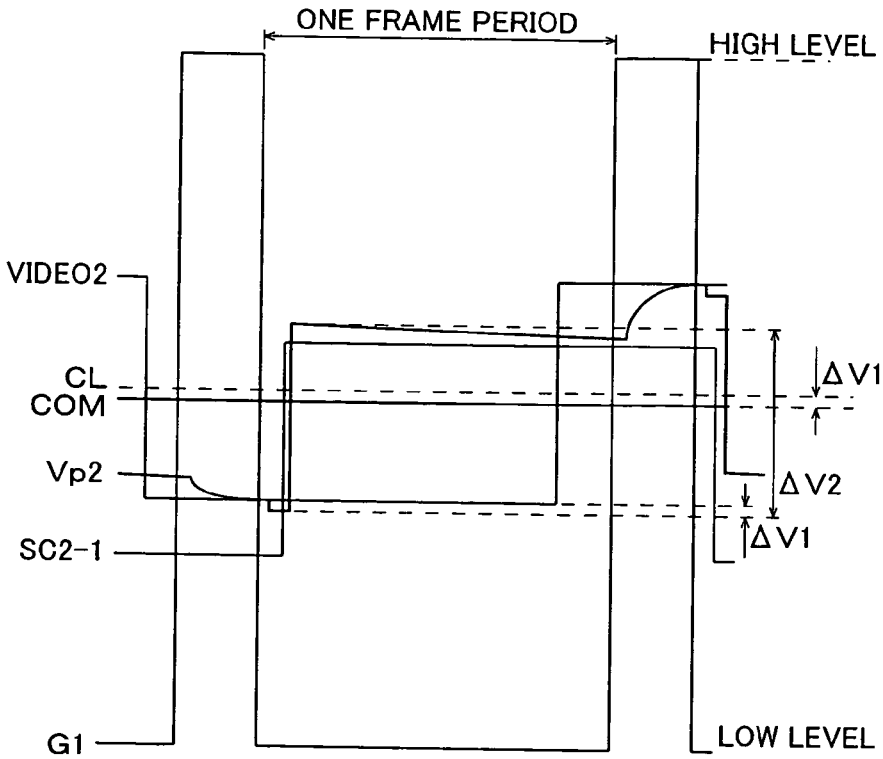
Figure 13:
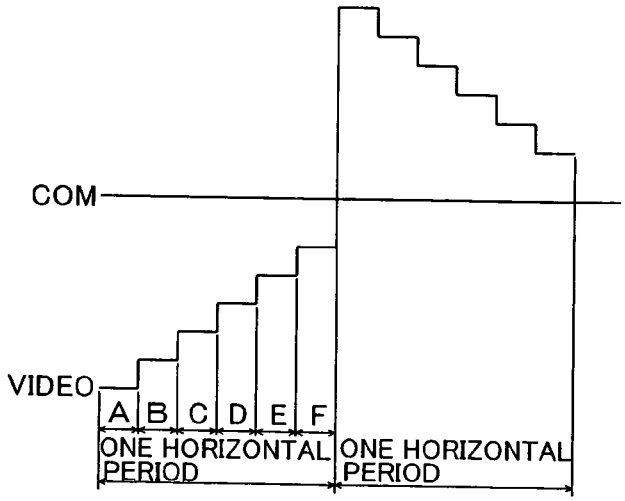
FIG.13 PRIOR ART
FIG. 13 is a waveform diagram showing a case of driving a liquid crystal display by a conventional line inversion driving method.
Figure 14:
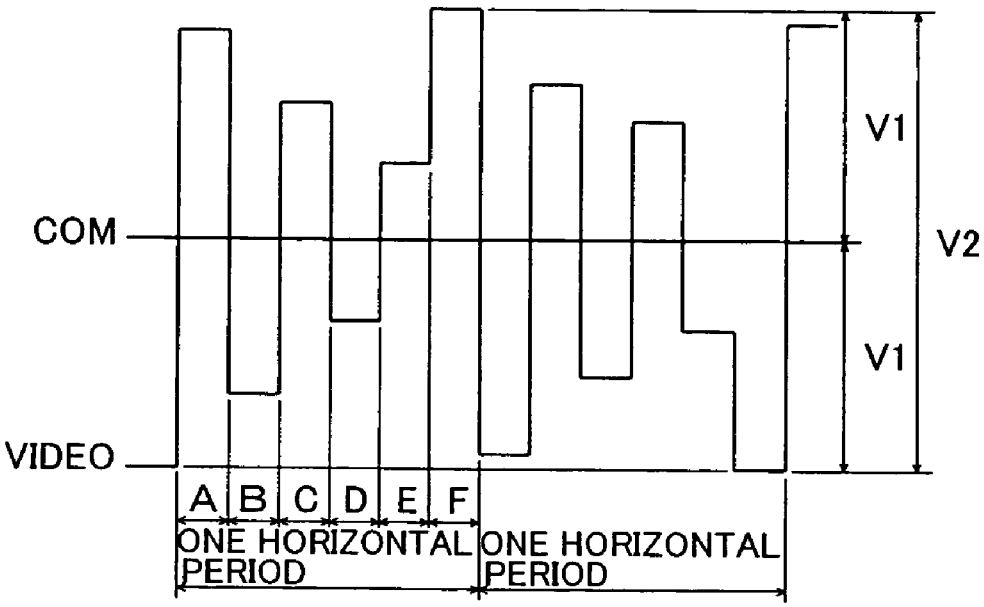
FIG.14 PRIOR ART
FIGS. 14 is a waveform diagram showing a case of driving a liquid crystal display by a conventional dot inversion driving method.

The liquid crystal display turns on the n-channel transistor 32 in the pixel portion 3*b* (see FIG. 1), thereby writing the low-level video signal in the pixel portion 3*b*. In other words, the pixel voltage supply source Vp2 goes down to the level of the video signal line VIDEO2, as shown in FIG. 12. Then, the signal supplied to the gate line G1 goes low, thereby turning off the n-channel transistor 32. Thus, the liquid crystal display completes the operation of writing the low-level video signal in the pixel portion 3*b* and lowers the pixel voltage supply source Vp2 by ΔV1. After the signal supplied to the gate line G1 goes low, the liquid crystal display supplies the high-level signal VSCH to the subsidiary capacitance line SC2-1, thereby supplying the high-level signal to the second electrode 37*b* (see FIG. 1) of the subsidiary capacitor 33 and raising the voltage supply source of the subsidiary capacitance 33 to a high level. Thus, the liquid crystal display raises the pixel voltage supply source Vp2 by ΔV2 and holds the pixel voltage supply source Vp2 raised by ΔV2 for one frame period.

Also in the pixel portions arranged along the second- to fifth-stage gate lines G2 to G5 (see FIG. 2), the liquid crystal display sequentially performs operations similar to those on the pixel portions 3*a* and 3*b* (see FIG. 1) arranged along the first-stage gate line G1. After completion of the first-frame operations, the liquid crystal display inverts the video signals supplied to the video signal lines VIDEO1 and VIDEO2 to low- and high-levels with respect to the voltage supply source COM of the common electrode 35 (see FIG. 1) respectively.

Then, the liquid crystal display switches the clock signal XCKVSC supplied to the signal supply circuit 7 (see FIG. 1) to a high level. Thereafter the liquid crystal display inputs the high-level clock signal XCKVSC in the input terminal A of the clocked inverter 72*a* in the signal supply circuit portion 7*a* as shown in FIG. 3, thereby turning on the switches 73*a* and 73*c* while turning off the switches 73*b* and 73*d* contrarily to the case of the low-level clock signal XCKVSC. Consequently, the liquid crystal display supplies the high- and low-level signals VSCH and VSCL to the subsidiary capacitance lines SC1-1 and SC2-1 respectively. Also in the signal supply circuit portions 7*b* to 7*d* (see FIG. 2), the liquid crystal display performs operations similar to those on the signal supply circuit portion 7*a*.

Thus, the liquid crystal display performs the operations shown in FIGS. 12 and 11 in the pixel portions 3*a* and 3*b* respectively in the second frame. Also in third and subsequent frames, the liquid crystal display alternately switches video signals supplied to the video signal lines VIDEO1 and VIDEO2 (see FIG. 1) between high and low levels and low and between high levels respectively every frame period. The liquid crystal display further alternately switches the clock signal XCKVSC supplied to the signal supply circuit 7 between low and high levels, thereby alternately switching the low- and high-level signals VSCL and VSCH supplied to the subsidiary capacitance lines SC1-1 to SC1-4 (see FIG. 2) and SC2-1 to SC2-4 (see FIG. 2) respectively. Thus, the liquid crystal display according to the embodiment of the present invention negatively/positively reverses the image.

According to this embodiment, as hereinabove described, the liquid crystal display provided with the signal supply circuit 7 supplying the high- and low-level signals VSCH and VSCL to the subsidiary capacitance lines SC1-1 to SC1-4 and SC2-1 to SC2-4 of the pixel portions 3*a* and 3*b* supplies the high-level signal VSCH to the electrode 37*a* of the subsidiary capacitor 33 of the pixel portion 3*a* through the subsidiary capacitance lines SC1-1 to SC1-4 thereby raising the voltage supply source of the electrode 37*a* of the subsidiary capacitor 33 of the pixel portion 3*a* to a high level assuming that the same supplies the high- and low-level signals VSCH and VSCL to the subsidiary capacitance lines SC1-1 to SC1-4 and SC2-1 to SC2-4 of the pixel portions 3*a* and 3*b* respectively, for example. Further, the liquid crystal display supplies the low-level signal VSCL to the electrode 37*b* of the subsidiary capacitor 33 of the pixel portion 3*b* through the subsidiary capacitance lines SC2-1 to SC2-4, thereby lowering the voltage supply source of the electrode 37*b* of the subsidiary capacitor 33 of the pixel portion 3*b*. Thus, the liquid crystal display can render the pixel voltage supply source Vp1 of the pixel portion 3*a* higher than that immediately after an operation of writing the high-level video signal in the pixel portion 3*a* by supplying the high-level signal VSCH to the electrode 37*a* of the subsidiary capacitor 33 of the pixel portion 3*a* after writing the high-level video signal. Further, the liquid crystal display can render the pixel voltage supply source Vp2 of the pixel portion 3*b* lower than that immediately after an operation of writing the low-level video signal in the pixel portion 3*b* by supplying the low-level signal VSCL to the electrode 37*b* of the subsidiary capacitor 33 of the pixel portion 3*b* after writing the low-level video signal. Thus, the voltages of the video signals may not be increased, whereby the liquid crystal display can easily suppress increase of power consumption resulting from increased voltages of the video signals. Consequently, the liquid crystal display can reduce power consumption.

According to this embodiment, further, the liquid crystal display can render the pixel voltage supply source Vp1 of the pixel portion 3*a* lower than that immediately after the operation of writing the high-level video signal in the pixel portion 3*a* by supplying the low-level signal VSCL to the electrode 37*a* of the subsidiary capacitor 33 of the pixel portion 3*a* after writing the high-level video signal. The liquid crystal display can further render the pixel voltage supply source Vp2 of the pixel portion 3*b* higher than that immediately after the operation of writing the low-level video signal in the pixel portion 3*b* by supplying the high-level signal VSCH to the electrode 37*b* of the subsidiary capacitor 33 of the pixel portion 3*b* after writing the low-level video signal. Thus, the liquid crystal display, which can negatively/positively reverse the image, may not invert the respective bits when negatively/positively reversing a 6-bit video signal, for example. Therefore, the liquid crystal display can simplify the circuit for reversing the image and reduce power consumption as compared with a case of inverting the respective bits of the 6-bit video signal. Further, the liquid crystal display can easily perform dot inversion driving by adjacently arranging the pixel portions 3*a* and 3*b*. In this case, no flickering linearly takes place dissimilarly to a case of performing line inversion driving, whereby the liquid crystal display can easily render flickering hard to visually recognize.

According to this embodiment, the phase control circuit 9*a* is constituted of the inverter 91*a* for inverting the clock signal CKVSC, the p-channel transistor 93 connected to the input terminal of the inverter 91*a* and turned on when the clock signal CKVSC is at a low level and the n-channel transistor 92 connected to the output terminal of the inverter 91*a* and turned on when the clock signal CKVSC is at a high level, whereby the structure of the phase control circuit 9*a* serving as a circuit for negatively/positively reversing an image can be simplified as compared with the conventional case of employing the video signal inversion circuit having six inverters for inverting the respective bits of a 6-bit video signal, for example.

According to this embodiment, the signal supply circuit portions 7*a* to 7*d* are provided in correspondence to the gate lines G1 to G4 respectively, whereby the liquid crystal display can sequentially supply the high- and low-level signals VSCH and VSCL to the subsidiary capacitance lines SC1-1 to SC1-4 and SC2-1 to SC2-4 corresponding to the gate lines G1 to G4 respectively through the signal supply circuits 7*a* to 7*d* when sequentially writing video signals in the pixel portions 3*a* and 3*b* of the gate lines G1 to G4. Further, the liquid crystal display can sequentially supply the low- and high-level signals VSCL and VSCH to the subsidiary capacitance lines SC1-1 to SC1-4 and SC2-1 to SC2-4 corresponding to the gate lines G1 to G4 respectively through the signal supply circuit portions 7*a* to 7*d* when sequentially writing video signals in the pixel portions 3*a* and 3*b* of the gate lines G1 to G4 for reversing an image.

According to this embodiment, the liquid crystal display provided with the V driver 6 for sequentially driving the plurality of gate lines G1 to G5 and the shift register 8 for sequentially driving the plurality of signal supply circuit portions 7*a* to 7*d* can easily sequentially drive the signal supply circuit portions 7*a* to 7*d*, corresponding to the gate lines G1 to G5 sequentially driven by the V driver 6, through the shift register 8.

According to this embodiment, the liquid crystal display can easily render the pixel voltage supply sources of all pixel portions 3*a* and 3*b* arranged along the gate line G1 higher or lower than those immediately after the operations of writing video signals in all pixel portions 3*a* and 3*b* arranged along the gate line G1 through the signal supply circuit portion 7*a* by supplying either the high-level signal VSCH or the low-level signal VSCL to the subsidiary capacitance line S1-1 and supplying either the low-level signal VSCL or the high-level signal VSCH to the subsidiary capacitance line SC2-1 after writing the video signals.

According to this embodiment, the liquid crystal display can easily perform dot inversion driving by alternately switching the high- and low-level signals VSCH and VSCL supplied to the subsidiary capacitance lines SC1-1 to SC1-4 and SC2-1 to SC2-4 every frame period for writing video signals in all pixel portions thereby inverting the pixel voltage supply sources Vp1 and Vp2 of the video signals written in the pixel electrodes 34 of the pixel portions 3*a* and 3*b* with respect to the voltage supply source COM of the common electrode 35 every frame period through the signal supply circuit portions 7*a* to 7*d*. In this case, the liquid crystal display can easily suppress seizure (afterimage phenomenon).

Although the present invention has been described and illustrated in detail, it is clearly understood that the same is by way of illustration and example only and is not to be taken by way of limitation, the spirit and scope of the present invention being limited only by the terms of the appended claims.

For example, while each signal supply circuit portion has the circuit structure shown in FIG. 3 in the aforementioned embodiment, the present invention is not restricted to this but each signal supply circuit portion may simply be capable of supplying high- and low-level signals to at least a pair of subsidiary capacitance lines respectively. Further, each signal supply circuit portion may simply be capable of alternately switching high- and low-level signals supplied to at least a pair of subsidiary capacitance lines every frame period.

While the liquid crystal display performs dot inversion driving by adjacently arranging the pixel portions 3*a* and 3*b* in the aforementioned embodiment, the present invention is not restricted to this but the liquid crystal display may alternatively perform block inversion driving by constituting first and second blocks of only a plurality of pixel portions 3*a* and only a plurality of pixel portions 3*b* respectively and adjacently arranging the first and second blocks.

While the liquid crystal display sequentially turns on the n-channel transistors for driving the drain lines in the aforementioned embodiment, the present invention is not restricted to this but the liquid crystal display may alternatively simultaneously turn on all n-channel transistors for driving the drain lines.

While the liquid crystal display sequentially drives the plurality of signal supply circuit portions through the shift register including the shift register circuit portions similar in circuit structure to the shift register circuit portions of the V driver in the aforementioned embodiment, the present invention is not restricted to this but the liquid crystal display may alternatively employ a shift register including shift register circuit portions different in circuit structure to the shift register circuit portions of the V driver so far as the same can sequentially drive the plurality of signal supply circuit portions.

While the liquid crystal display supplies the high- and low-level signals to at least a pair of subsidiary capacitance lines corresponding to a prescribed-stage gate line at timing similar to that for writing the video signals in the pixel portions along the subsequent-stage gate line in the aforementioned embodiment, the present invention is not restricted to this but the liquid crystal display may alternatively supply prescribed signals to at least a pair of subsidiary capacitance lines corresponding to a prescribed-stage gate line at timing different from that for writing video signals in pixel portions along a subsequent-stage gate line.

While the phase control circuit has the circuit structure shown in FIG. 4 in the aforementioned embodiment, the present invention is not restricted to this but the phase control circuit may have another circuit structure so far as the same can generate the clock signal CKVSC and the inverted clock signal XCKVSC and supply either the clock signal CKVSC or the inverted clock signal XCKVSC to the signal supply circuit.

What is claimed is:

1. A display comprising:

a plurality of drain lines and a plurality of gate lines arranged to intersect with each other;

a first pixel portion and a second pixel portion each including a subsidiary capacitor having a first electrode connected to a pixel electrode and a second electrode, wherein said first pixel portion and said second pixel portion are serially arranged in a direction parallel to said gate line;

a first subsidiary capacitance line connected to said second electrode of said subsidiary capacitor of said first pixel portion and not connected to said second electrode of said subsidiary capacitor of said second pixel portion, and a second subsidiary capacitance line connected to said second electrode of said subsidiary capacitor of said second pixel portion and not connected to said second electrode of said subsidiary capacitor of said first pixel portion; and a signal supply circuit including a plurality of signal supply circuit portions supplying either a first signal having a first voltage supply source or a second signal having a second voltage supply source for negatively/positively reversing an image to said first subsidiary capacitance line of said first pixel portion while supplying either a third signal having a third voltage supply source or a fourth signal having a fourth voltage supply source for negatively/positively reversing said image to said second subsidiary capacitance line of said second pixel portion, wherein video signals whose polarities are opposite to each other are supplied to said first pixel portion and said second pixel portion, respectively, and when the image is negatively/positively reversed, said second signal whose polarity is reversed to that of a video signal supplied to said first pixel portion is supplied to said first subsidiary capacitance line, and said fourth signal whose polarity is reversed to that of a video signal supplied to said second pixel portion is supplied to said second subsidiary capacitance line.

2. The display according to claim 1, further comprising a phase control circuit generating a first control signal making said signal supply circuit output a signal for displaying said image and a second control signal making said signal supply circuit output a signal for negatively/positively reversing said image and supplying either said first control signal or said second control signal to said signal supply circuit.

3. The display according to claim 2, generating said second control signal by inverting the phase of said first control signal.

4. The display according to claim 3, wherein said first control signal is a clock signal, and said second control signal is an inverted clock signal obtained by inverting the phase of said clock signal.

5. The display according to claim 2, supplying said first signal and said third signal to said first subsidiary capacitance line and said second subsidiary capacitance line respectively when said phase control circuit supplies said first control signal to said signal supply circuit, and supplying said second signal and said fourth signal to said first subsidiary capacitance line and said second subsidiary capacitance line respectively when said phase control circuit supplies said second control signal to said signal supply circuit.

6. The display according to claim 2, wherein said phase control circuit includes:

an inverter circuit for inverting said first control signal, a first conductive type first transistor connected to an input terminal of said inverter circuit and turned on when a phase control signal is at a first level, and a second conductive type second transistor connected to an output terminal of said inverter circuit and turned on when said phase control signal is at a second level.

7. The display according to claim 6, wherein a phase control signal line for supplying said phase control signal is connected to the gates of said first transistor and said second transistor.

8. The display according to claim 2, further comprising a driving circuit for driving said display, wherein said phase control circuit is built in said driving circuit.

9. The display according to claim 2, wherein said signal supply circuit portions are provided in one-to-one correspondence to said plurality of gate lines respectively, and each said signal supply circuit portion sequentially supplies said first signal and said third signal to said first subsidiary capacitance line and said second subsidiary capacitance line of corresponding said gate line respectively on the basis of said first control signal supplied from said phase control circuit when displaying said image while sequentially supplying said second signal and said fourth signal to said first subsidiary capacitance line and said second subsidiary capacitance line of corresponding said gate line respectively on the basis of said second control signal supplied from said phase control circuit when reversing said image.

10. The display according to claim 1, further comprising:

a gate line driving circuit including a first shift register for sequentially driving said plurality of gate lines, and a second shift register provided independently of said gate line driving circuit including said first shift register for sequentially driving said plurality of signal supply circuit portions.

11. The display according to claim 10, wherein said second shift register includes a plurality of shift register circuit portions, and prescribed-stage said signal supply circuit portion supplies either said first signal or said second signal to said first subsidiary capacitance line of said first pixel portion while supplying either said third signal or said fourth signal to said second subsidiary capacitance line of said second pixel portion in response to an output signal from said shift register circuit portion subsequent to said prescribed-stage signal supply circuit portion.

12. The display according to claim 11, driving said second shift register with the same pulse signal as a pulse signal for driving said first shift register.

13. The display according to claim 1, wherein said first pixel portion and said second pixel portion are adjacently arranged.

14. The display according to claim 1, wherein said signal supply circuit portions supply either said first signal or said second signal to said first subsidiary capacitance line while supplying either said third signal or said fourth signal to said second subsidiary capacitance line after writing a video signal in all said pixel portions arranged along at least one said gate line.

15. The display according to claim 1, wherein said signal supply circuit portions alternately switch either said first signal or said second signal supplied to said first subsidiary capacitance line and either said third signal or said fourth signal supplied to said second subsidiary capacitance line every frame period for writing a video signal in all said pixel portions.

16. The display according to claim 1, wherein said first pixel portion and said second pixel portion are adjacently arranged, and video signals supplied to said first electrodes of said first pixel portion and said second pixel portion have waveforms inverse to each other.

17. The display according to claim 1, wherein said first voltage supply source of said first signal and said fourth voltage supply source of said fourth signal are at substantially identical levels, and said second voltage supply source of said second signal and said third voltage supply source of said third signal are at substantially identical levels.

18. The display according to claim 1, wherein pixels of said first pixel portion and said second pixel portion include liquid crystals.

* * * * *